United States Patent [19]

Borsuk

[11] Patent Number: 4,827,621

[45] Date of Patent: May 9, 1989

[54] MEASUREMENT TAPE FOR SIZING CARPET

[76] Inventor: Philip Borsuk, 624 Tigertail Rd., Los Angeles, Calif. 90049

[21] Appl. No.: 74,297

[22] Filed: Jul. 16, 1987

[51] Int. Cl.[4] ..... B32B 31/10

[52] U.S. Cl. ..... 33/758; 33/494; 33/1 K; 33/1 B; 33/1 G; 33/759

[58] Field of Search ..... 33/121, 137, 1 K, 1 G, 33/1 C, 494, 1 AA, 526, 527

[56] References Cited

U.S. PATENT DOCUMENTS

| | | | |
|---|---|---|---|
| 472,266 | 4/1892 | Kindle et al. . | |
| 972,528 | 10/1910 | Halloran . | |
| 1,264,670 | 4/1918 | McMaster . | |
| 1,742,684 | 1/1930 | Bowman . | |
| 2,129,429 | 10/1940 | Osterberg . | |
| 2,189,857 | 2/1940 | Crapez . | |
| 2,747,795 | 5/1956 | Kreuttner . | |
| 2,842,772 | 7/1958 | Littman . | |
| 3,377,707 | 4/1968 | Breese . | |
| 3,496,372 | 2/1970 | Landberg . | |
| 3,789,857 | 2/1974 | Murray, Jr. . | |
| 3,794,554 | 2/1974 | Caring | 33/2 R X |
| 3,890,715 | 6/1975 | Kaplan . | |
| 4,404,750 | 9/1983 | Marx et al. . | |
| 4,408,782 | 10/1983 | Condon . | |
| 4,659,409 | 4/1987 | Arafat | 33/527 X |

OTHER PUBLICATIONS

Ad copy for the Swift Accu-Measure Carpet Measuring System—Unpublished.

*Primary Examiner*—Harry N. Haroian
*Attorney, Agent, or Firm*—Spensley Horn Jubas & Lubitz

[57] ABSTRACT

The present invention relates to a method and apparatus for allowing the accurate calculation of the minimum number of linear feet of carpet which must be cut from a standard width roll and delivered to an installation site to completely, properly and efficiently cover the floor at the installation site. The present invention provides a length of measurement tape which is scaled in width to the width of a standard roll of carpet. The measurement tape is perforated at increments along its length and width, and includes indicators of carpet grain direction and pattern repetition intervals along its length and/or width.

17 Claims, 4 Drawing Sheets

MEASUREMENT TAPE FOR SIZING CARPET

BACKGROUND OF THE INVENTION

1. Field of the Invention

The present invention relates to measurement devices for sheet materials, and more particularly, to measurement devices which facilitate the accurate determination of the quantity of carpet which should be delivered to an installation site, such as a home or office.

2. Description of the Prior Art

The retail carpet industry has long been plagued with the problem of how to best calculate the quantity of carpet which should be delivered to a particular site for installation. For the purposes of better understanding the critical importance placed on these calculations, the basic operation of the retail carpet industry is described below.

When a customer chooses a particular carpet for a home or office, the carpet retailer will usually quote the customer a price based upon the number of square feet of floor which must be covered with carpet. However, it is important to understand that carpet is manufactured and sold to carpet retailers in rolls having a standard width. In the United States, for example, carpet is sold to retailers in rolls having twelve foot widths. Therefore, after the floor plan of the installation site is known, the carpet retailer is faced with the usually difficult task of calculating how many linear feet of carpet to cut from the standard width roll and send to the installation site. The difficulty of this task will be made more apparent below.

If the retailer maintains the particular desired carpet in stock, the retailer will then deliver the calculated length of standard width carpet to the installation site. If the retailer does not carry the chosen carpet in stock, or if the retailer does not have the calculated quantity of the chosen carpet in stock, then an order must be placed with the manufacturer for the calculated quantity or an entire roll. In either event, the carpet is then installed at the installation site by employees or contractors of the retailer.

If too much carpet is delivered to the installation site, the excess carpet, which usually must be discarded as waste, results in unnecessary expense to the customer.

A much more serious situation arises when an insufficient quantity of carpet, called a "short measure", has been delivered to the installation site. Unfortunately, the fact that a deficiency exists is usually realized only after a majority of the delivered carpet has been installed and considerable installation time has been expended. In such a case, the retailer will usually first determine whether he has a sufficient amount of the same carpet in stock to overcome the deficiency. If he does not, the retailer must contact the manufacturer to see whether the manufacturer can cover the deficiency with the same dye lot. If the retailer is unsuccessful in obtaining the additional quantity of the matching dye lot, then the installed carpet must be removed and replaced with an amount of a new carpet which is sufficient to cover the entire floor. In many instances, the removed carpet is not suitable for reuse.

Also, once the retailer has agreed with the customer as to the total price and estimated yardage needed for the job, and once most of the carpet has already been laid, it is highly unlikely that the customer would agree to pay more money for the extra yardage needed at this stage. The retailer therefore must absorb the additional expense.

The costs incurred by a retailer when an insufficient quantity of carpet is delivered to the installation site can be substantial. In the more serious situation, where the remaining carpet required to complete the installation cannot be obtained, the retailer must absorb the cost of the original carpet and also the cost of its installation and removal. Moreover, even if the deficiency in the previously installed carpet can be made up from the retailer's stock or can be supplied by the carpet manufacturer, then the installation schedule is disrupted, orders may become backlogged, and the carpet installer's time will not be utilized efficiently. As may easily be envisioned, short measures may seriously affect the profitability of a carpet retailer.

Many factors go into the proper calculation of the amount of carpet which should be delivered to an installation site. First, a minimum quantity of carpet corresponding to that which is required to cover the entire floor must be supplied to the installation site. To this minimum amount must be added additional quantities which are due to several factors. For example, the retailer must take into consideration the grain of the carpet pieces which will cover the floor of the installation site. It is absolutely necessary to install carpet so that the grain of each piece runs in the same direction as the adjacent piece. A piece of carpet which otherwise may be of the correct size and shape to cover a portion of the installation site thus may not have the correct shape if it is turned so that its grain remains consistent with the adjacent carpet piece. In addition, the retailer must also consider the continuity of the carpet pattern at the seams of the carpet pieces. For example, a piece of carpet may be of the correct size, shape and grain direction to cover a portion of the floor, but its pattern may not be continuous with the pattern of the adjacent pieces.

As a consequence of the above-listed factors, waste or scrap pieces of carpet are usually created when the standard width carpet is cut during installation to fit the contours of the installation site floor. Since the cost of waste pieces must be paid for by the customer, it is desirable to minimize the amount of wasted carpet by utilizing carpet scraps, cut from pieces of carpet which have already been installed, to cover the floor of the installation site instead of using freshly cut pieces from the standard width carpet roll.

As can easily be seen from the above description, a miscalculation of the number of linear feet of standard width carpet to be delivered to an installation site can be a critical factor in the material and labor expense of the retailer, and to the inconvenience of the customer. With all of the factors which must be accounted for, the calculation is complex, and the likelihood of error is high.

Even if the above-mentioned factors are all properly accounted for by the retailer, on many occasions, the carpet layer may not install the carpet in the same manner envisioned by the retailer. As a result, the delivered carpet may not be sufficient to cover the entire floor of the installation site in an acceptable manner according to the customer (i.e., too many seams), even though sufficient carpet may have been delivered to cover the floor in an acceptable manner had the carpet been installed according to the retailer's plans. Since it is much more costly for the retailer if an insufficient amount of carpet is delivered to the installation site, most retailers err on the side of delivering too much carpet rather than too little, and unfortunately, the customer pays for the waste.

SUMMARY OF THE INVENTION

The present invention relates to a method and apparatus for allowing the accurate calculation of the minimum number of linear feet of carpet which must be cut from a standard width roll and delivered to an installation site to completely, properly and efficiently cover the floor at the installation site. The present invention allows the calculation to easily take into account factors such as uniform grain direction of adjacent carpet pieces and pattern continuity at the seams of adjacent pieces.

The present invention is characterized by providing a roll of measurement tape which is scaled in width to the width of a standard roll of carpet. The measurement tape may be perforated at increments along its length and width, and includes indicators of carpet grain direction and pattern repetition intervals along its length and/or width.

In use, pieces of the tape are removed from the roll by cutting or tearing along the perforations and are adhered to a transparent sheet which is laid over a scaled floor plan of an installation site. The pieces of tape are positioned in a manner representative of how the site is to be covered with carpet pieces. The particular size and shape of the pieces may be easily selected by tearing the pieces from the roll of tape along the perforations. Unused pieces of the tape represent potential waste carpet pieces. Since these pieces of tape (1) may be easily handled and accounted for, (2) are representative of the size and shape of the carpet scrap and (3) contain indicators of grain direction and pattern repetition, a determination may be easily made as to whether they are suitable for use in covering alternate areas of the floor plan, thereby minimizing the amount of carpet waste created. The total amount of carpet required to be delivered to the installation site may be made by determining the length of the scaled roll of tape which was required to completely cover the scaled floor plan.

In addition, since the tape required to perform the determination is far less expensive than the carpet itself, numerous calculations may be performed utilizing different manners of tape piece placement on different transparent sheets covering the floor plan in order to determine which manner of cutting and positioning the carpet is the most economical with the least amount of seams.

DETAILED DESCRIPTION OF THE PREFERRED EMBODIMENT

The following description is of the best presently contemplated mode of carrying out the present invention. This description is made for the purposes of illustrating the general principles of the invention and is not to be taken in a limiting sense. The scope of the invention is best determined by reference to the appended claims.

The present invention is designed to simulate, on a small scale, the installation of carpet at an actual installation site. A measurement tape, which is used as a scale model of a standard size roll of carpet, is carefully cut or torn into pieces and is placed over a scale floor plan of the installation site in a manner in which the installation site is to covered by actual pieces of carpet. By calculating the length of the measurement tape which is required to cover the scale floor plan of the installation site, the quantity of standard width carpet which should be delivered to the actual installation site may be precisely determined using the known scale ratio between the carpet measurement tape and the actual installation site. In this manner, the retailer can avoid inaccurate calculations, financial losses and inconveniences due to the delivery of insufficient or excess quantities of carpet to installation sites.

Figure 1:
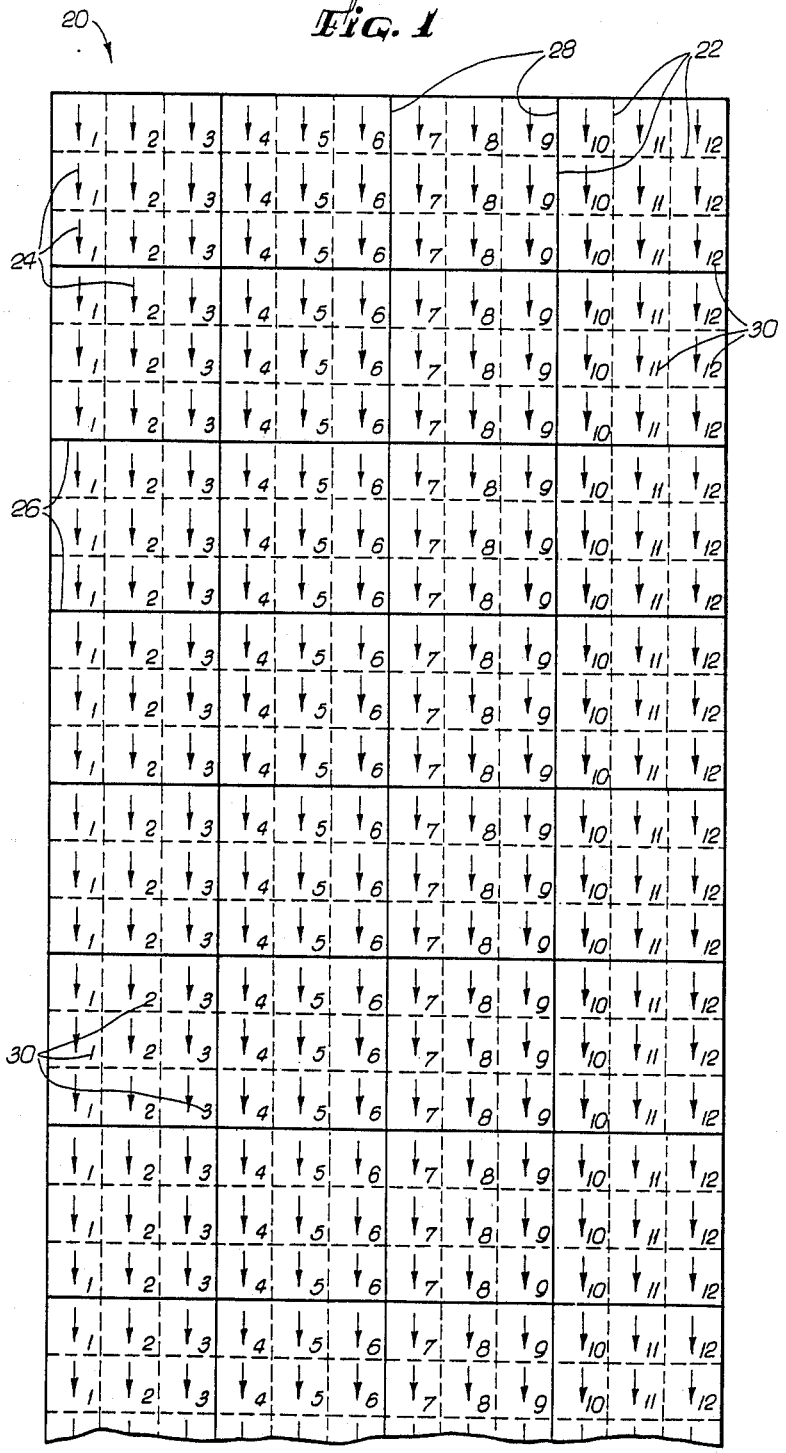
FIG. 1 illustrates a ¼ inch scale top view of a length of the adhesive measurement tape of the present invention.

FIG. 1 illustrates a portion of a roll of measurement tape 20 of the present invention. The measurement tape 20 is formed of a sheet material, such as paper, having one adhesive side. The tape is preferably, but not necessarily, transparent and may have a removable backing (not shown) covering its adhesive surface to prevent unintended adhesion Moreover, the adhesive property of the tape is preferably such that the tape can be removed from a surface, repositioned and readhered. The width of the measurement tape is scaled to the width of a standard roll of carpet. For example, since a standard roll of carpet has a width of 12 feet in the United States, if a scale of ¼ inch to 1 foot is used, the measurement tape should have a width of 3 inches. It is preferable for the same scale to be utilized for the length direction of the measurement tape as is utilized for the width direction. To continue the example, the scale in the width direction should also be ¼ inch to 1 foot.

The measurement tape (and backing, if provided) is perforated at regular intervals along its width and its length. The distances between the intervals should preferably correspond to scaled distances at which carpet is normally measured and cut for delivery to the installation site. For example, it is common in the United States to measure carpet for delivery in intervals of feet. Accordingly, continuing with the example, the perforations 22 should be positioned in the length and width directions of the tape at intervals of every ¼ inch. The perforations 22 should therefore divide the measurement tape into squares of ¼ inch by ¼ inch which are representative of a square foot of carpet.

The measurement tape contains indicators 24 of the direction of the grain of the roll of carpet represented by the tape. For example, the indicators 24 may be in the form of arrows, with each arrow of the tape pointing in the same grain direction, as illustrated in FIG. 1. As an alternative example, the indications 24 may be in the form of plural parallel hatch marks and/or perpendicular lines. Preferably, a grain direction indicator 24 should be provided at each perforated block of the measurement tape. For example, in FIG. 1, each ¼ inch by ¼ inch block contains an arrow in its center, with the direction of each arrow being identical for the same roll of tape. The grain direction indicators 24 are designed to assist in maintaining continuity in the grain of each piece of carpet in relation to all of the other pieces of carpet during installation. Thus, when different pieces of the tape are placed adjacent to one another in a manner simulating the placement of adjacent carpet pieces of the same roll, it will be readily apparent from the direction of the arrows of the various pieces of measurement tape whether their grain direction is identical.

The measurement tape of the present invention also contains indicators 26 of the distance intervals at which the pattern of the carpet represented by the tape repeats along the length direction. In the United States, carpet patterns typically repeat every 3 feet along the length of the carpet. The measurement tape illustrated in FIG. 1 therefore contains a bold line or other pattern interval indicator at every ¾ inch interval along the length of the tape. In this manner, when two pieces of tape are placed adjacent to one another to represent adjacent pieces of carpet, it may be easily determined whether the actual represented carpet pattern will be continuous between the two pieces by observing whether the indicators 26 match one another. If the pattern is not continuous, this will also be readily apparent, as will the distance one piece must be adjusted with respect to the other to make the pattern continuous.

The present invention may also provide indicators 28 of the intervals at which the carpet pattern repeats along the width of the carpet. Carpet patterns in the United States typically repeat every 1½ or 3 feet in the direction of the width of the carpet. Bold lines or other indicators similar to those shown at the intervals along the length of the carpet may also be provided at the appropriate scaled intervals along the width of the tape.

The measurement tape 20 may also have width indicators 30 placed at different points along the width of the tape. The width indicators 30 assist the user in counting the number of feet between different points along the width of the measurement tape 20. For example, if an eight scale-foot wide piece of tape is desired, the user simply has to locate the width indicator "8" rather than counting over eight intervals from the left-hand edge of the tape before deciding along which perforation the roll should be torn. As illustrated, the measurement tape of FIG. 1 contains width indicator numerals placed alongside every longitudinal column of perforations. These numerals represent the 1, 2, 3, 4, 5, 6, 7, 8, 9, 10, 11 and 12 scale-foot widths of the measurement tape. Of course, less than every longitudinal column of perforations may be provided with such indicators.

Figure 2:
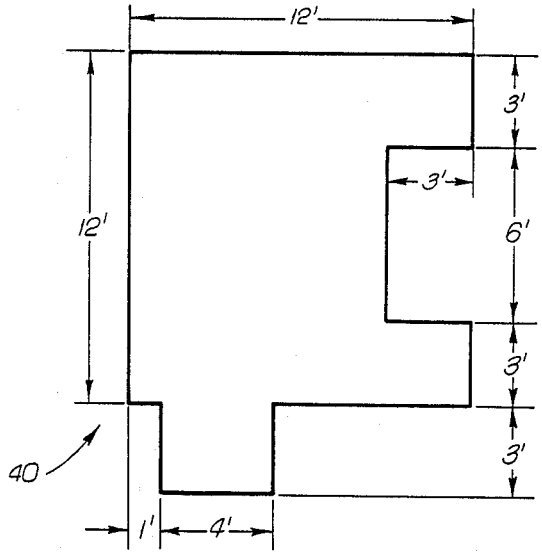
FIG. 2 illustrates a sample dimensioned floor plan layout of an installation site to be carpeted.
Figure 3:
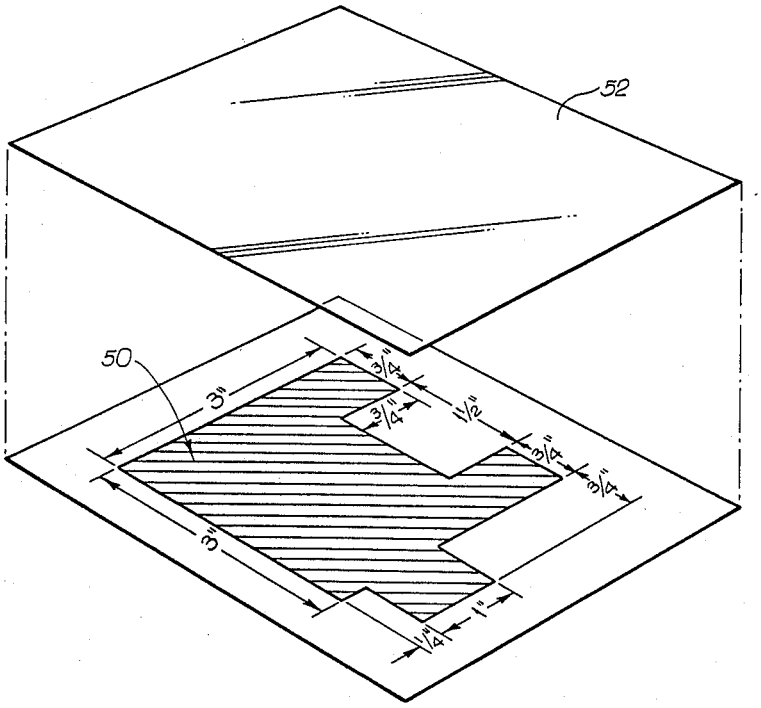
FIG. 3 illustrates a ¼ inch scaled drawing of the floor plan layout illustrated in FIG. 2 and a transparent sheet of tissue paper which, in use, is placed over the scaled drawing.

The manner in which the measurement tape of the present invention should be utilized is described below with respect to a sample dimensioned floor plan. FIG. 2 illustrates a sample scale floor plan 40 of an installation site to be carpeted Once the dimensions of the floor plan are known, a floor plan 50 such as illustrated in FIG. 3 should be constructed as a scale model representation, with a scale equal to the same scale as that of the measurement tape (¼ inch to 1 foot, to continue the example). As shown in FIG. 3, the scaled floor plan 50 is then covered with a transparent sheet of tissue paper 52 or other similar protective layer. Pieces of the measurement tape 20 may then be adhered to the transparent sheet 52 in a manner to simulate the placement of carpet over the actual floor of the installation site 40. For the purposes of illustration, one method of covering the scaled floor plan 50 will be described below.

Figure 4A:
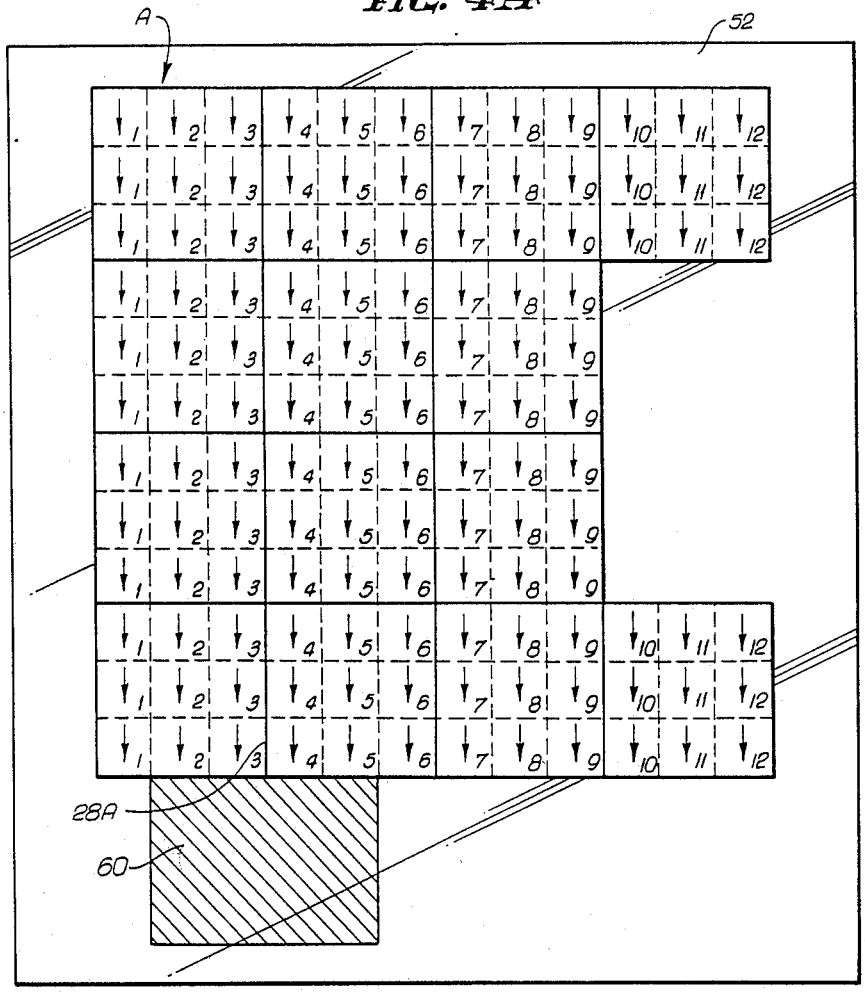
FIG. 4A illustrates a top view of block A of the measurement tape of FIG. 1 after it is adhered to the transparent sheet covering the scaled drawing of the floor plan illustrated in FIG. 3.
Figure 4B:
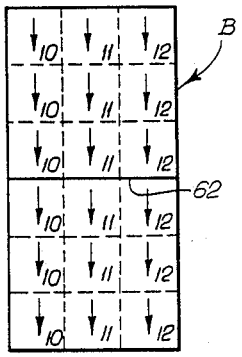
FIG. 4B illustrates a block B of the measurement tape which has been removed from the block A illustrated in FIG. 4A.

As illustrated in FIG. 4A, a block A of the measurement tape 20 having dimensions of 3" (12 scale-feet) in length and 3" (12 scale-feet) in width should first be removed from the roll of carpet measurement tape. In order to more closely simulate the shape of the scale model representation, a block B having dimensions of 1½" (6 scale-feet) in length and ¾" (3 scale-feet) in width is removed from the block A. This block B may then be placed to the side as scrap which may be used later should the need arise for a piece having such a size, shape, grain and pattern. The backing of block A should then be removed, and the block A placed over the scaled floor plan, as illustrated in FIG. 4A, so that the block A adheres to the transparent sheet 52 covering the floor plan 50.

As illustrated, a portion 60 of the floor plan still remains uncovered. At this point, it must be determined whether another piece of tape 20 should be removed from the carpet measuring roll, thus representing additional carpet which must be delivered to the installation site, or whether the area 60 may be covered with existing scrap pieces. In this instance, the scrap block B is available for use. However, before block B may be used, a careful determination must be made as to whether (1) the size of block B is sufficient to cover the uncovered portion 60, (2) whether the block B will cover portion 60 when it is oriented to have the same grain direction as the remainder of the carpet, and (3) whether the pattern of block B will remain continuous at its seam with the remainder of the carpet A. If the answer to all of these questions is yes, the block B may be used.

Figure 5:
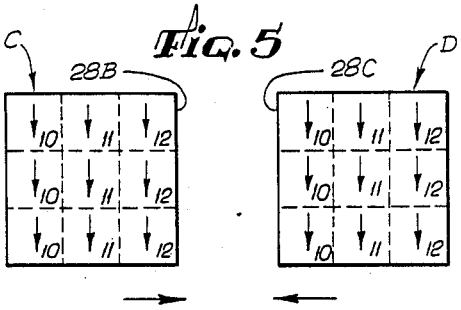
FIG. 5 illustrates the block B of FIG. 4B after it has been severed and its pieces reoriented.
Figure 6:
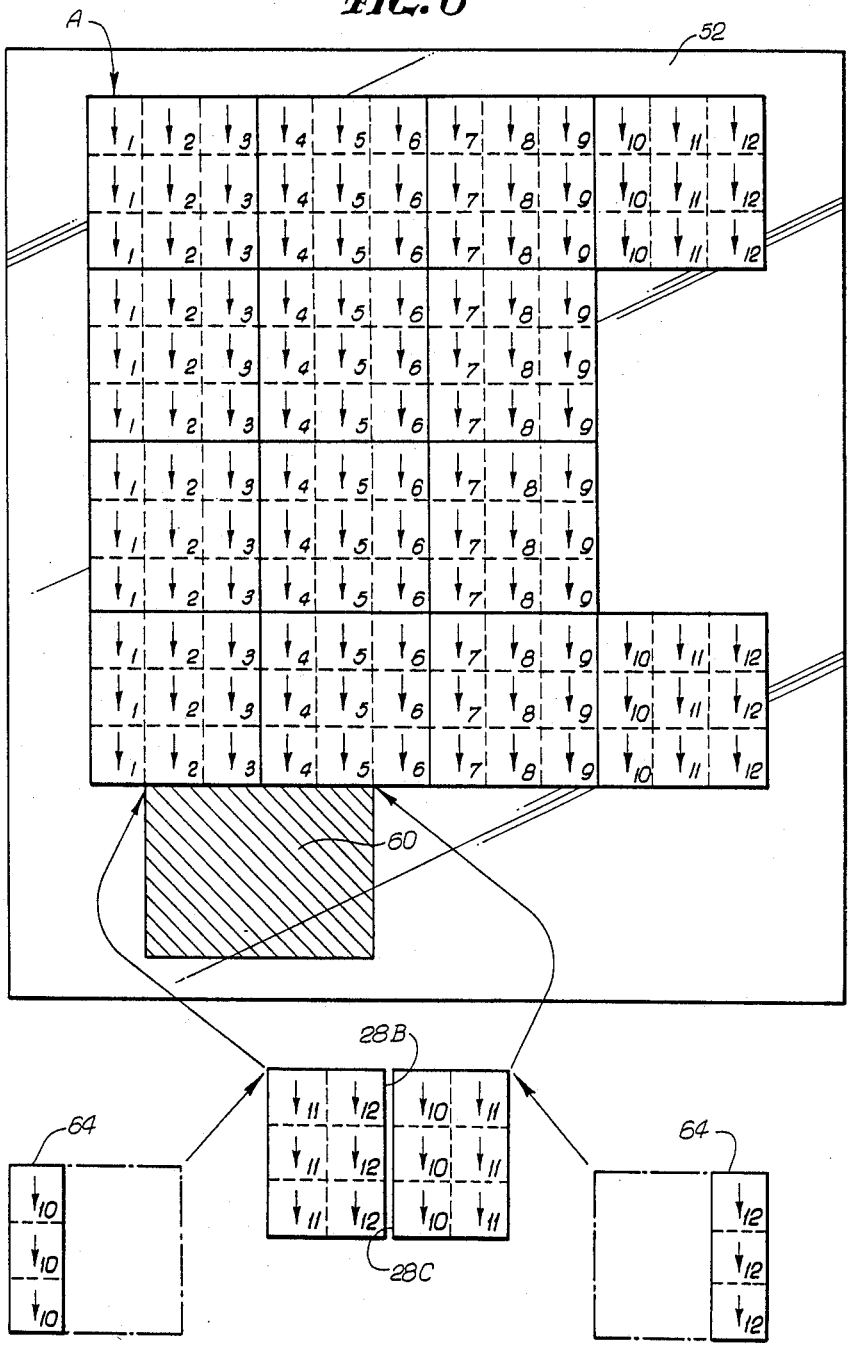
FIG. 6 illustrates the severed, reoriented and reconstructed pieces of block B before they are adhered adjacent to block A of the scaled drawing illustrated in FIG. 3.

Due to its grain direction, then block B cannot simply be rotated 90° to cover the uncovered portion 60. If this were done, the arrows of block A and block B would point in different directions. Rather, block B should be torn in half along the perforation 62 and reoriented into identical blocks C and D, as illustrated in FIG. 5. Next, the carpet pattern indicators of blocks C and D must be arranged to match those of block A such that a determination can be made as to which four foot width of the total 6 foot width of adjacent blocks C and D must be used. Since the pattern indicators 28A running along the length of block A match the pattern indicators 28B and 28C running along the shared seam if blocks C and D are positioned together, as illustrated in FIG. 6, only the center four foot width of blocks C and D are needed. Thus, the one scale foot (¼ inch) width strips 64 should be removed from the outside edges of block C and block D. The removed strips 64 may then be set aside for later use, if the need arises The backing layer may then be removed from both reshaped blocks C and D of the measuring tape, and blocks C and D adhered to the transparent sheet 52 to cover the portion 60.

As is apparent from the above example, the total quantity of carpet which should be supplied to the installation site (in the example, 12 linear feet of the standard 12 foot wide carpet roll) may be easily calculated by determining the length of the roll of tape which must be used to cover the entire scaled floor plan. At this point, it should be noted that if the carpet measuring tape totally covers the scale floor plan, then the retailer is guaranteed that the amount of carpet actually being sent to the installation site is sufficient to cover the entire floor. Of course, if the area to be covered with carpet has dimensions which are not exactly equal to an integral number of feet, then the user of my invention should still cover the entire scaled floor plan with tape torn at the perforations. The small excess amount of carpet can simply be trimmed off at the installation site.

In many cases, it may be desirable to test whether one method of cutting and positioning the carpet is more economical than another. In such a case, a separate transparent sheet may be positioned over the floor plan and the carpet measuring tape laid out in a different manner using the above described procedure. The carpet layout which results in the least amount of tape usage, without producing an excessive number of seams, is the more economical.

As an alternate embodiment of the present invention, the transparent sheet may be eliminated and the pieces of measurement tape may be directly adhered to the scale floor plan of the installation site. If multiple methods of cutting and placement of the measurement tape are desired to be tested, then multiple photocopies of the scale floor plan of the installation site may be used for each attempt at laying out the carpet.

Once a preferred method of placement of the measurement tape pieces on the scale floor plan has been determined, the scale floor plan with adhered tape pieces may be given to the installer so that the installer can then see exactly how each piece of carpet should be cut from the length of standard width carpet and positioned at the installation site.

It should now be apparent that, using my inventive method and tape, the possibility of delivering an insufficient amount of carpet (i.e., a short measure) to an installation site can be virtually eliminated. According to my invention, the scale floor plan of the area to be carpeted should be completely covered with tape. The retailer may then send a length of standard width carpet to the installation site corresponding to the number of linear scale feet of tape used to cover the entire scale floor plan. The retailer's completely tape-covered floor plan may then be given to the installer. When the installer cuts and lays-out the carpet in the same way that the tape pieces are cut and layed out on the scale floor plan, the retailer is assured that the carpet which is delivered to the cite will be sufficient to carpet the entire installation site. Short measures can thereby be completely eliminated. Moreover, the retailer can experiment with various ways of cutting and laying out the carpet using the tape and can pick the manner which results in the most efficient use of carpet and the carpet installers time. It is frequently the case that the carpet layout which results in the least waste of carpet will also have the most seams. However, it takes time, and thus money, to align and join seams. Experimenting with my inventive tape is far faster and less expensive than experimenting at the installation site with carpet. By first laying out tape over the scaled floor plan, the retailer can pick the carpet layout which results in the most clearly economical balance of seams and wasted carpet scraps.

In summary, the present invention provides a highly useful, virtually fool-proof visual aid which allows the user to accurately and inexpensively determine the total quantity of carpet which should be delivered to an installation site to cover a floor plan. The invention takes into consideration the size and shape of the carpet pieces to be used, as well as the grain direction and pattern of the carpet pieces. Determinations may therefore be made as to the most economical manner of cutting and installation. In addition, the invention allows the user to visually determine if and when scrap pieces generated during the installation procedure may be utilized as substitutes for newly cut to size pieces of carpet from the standard-width roll, thereby reducing the amount of wasted scrap carpet material generated. Moreover, the present invention also provides a visual aid to the carpet installer as to the manner in which the carpet pieces should be cut from the standard width carpet and installed at the installation site.

One preferred embodiment of the present invention has been illustrated and described in detail with respect to use in measuring carpet. However, the invention is not so limited Numerous variations within the spirit and scope of the invention are possible. For example, the invention is not limited only to use with carpet, but works equally well with linoleum and many other sheet-like materials which may be used to cover various defined areas.

This invention also may be used as a teaching tool for new personnel, such as estimators, carpet layers, and sales people Since carpet customers usually do not know how to compute the yardage they need for their homes or offices, they are usually at the mercy of the retailer and can be overcharged for more yardage than they actually need or use. This invention will serve as a safeguard to the customer since it will educate the customer as to the exact amount of yards required and being delivered to the job site. The customer will thus not have to pay for more carpet than is required.

I claim:

1. A device for determining the length of a roll of sheet-like material required to cover a defined surface area, wherein said sheet-like material has a pattern which repeats at 3 foot intervals, said device comprising:

a length of tape for stimulating the sheet-like material, said tape having a 12 scale foot width; and pattern repetition indicator means on the tape for indicating the 3 foot distance intervals at which said pattern of the sheet-like material repeats, and whether separated pieces of the tape positioned adjacent to each other are aligned to provide a continuous pattern between such adjacent pieces.

2. A device according to claim 1, wherein said tape includes indicators of the sealed length of said tape relative to the sheet-like material and wherein said length indicators are disposed at different points along the length of said tape.

3. A device according to claim 1, wherein said tape includes indicators of the scaled width of said tape relative to the roll of sheet-like material, and wherein said width indicators are disposed at different points along the width of said tape.

4. A device according to claim 1, further comprising re-adherable adhesive on one side surface of said tape.

5. A device according to claim 1, wherein said tape is perforated at intervals with columns and rows of holes along its length and width, respectively, such that the tape may be torn along the perforations into rectangular pieces.

6. A device according to claim 1, wherein said sheet-like material has a grain direction and the tape further includes grain direction means on said tape for indicating the grain direction of the sheet-like material.

7. A device according to claim 6, wherein said grain direction means include a plurality of markings on the tape, each of said markings being spaced along the length and width of thee tape such that when the tape is separated into two pieces along its length and width the markings indicate grain direction of the pieces.

8. A device according to claim 1, further comprising pattern repetition indicators for indicating 1½ scale foot distance intervals across the width of the tape.

9. A method for calculating the length of a roll of sheet-like material required to cover a predetermined area, said sheet-like material having a grain direction, said method comprising the steps of:

a. providing a scale model representation of the predetermined area;

b. providing a quantity of tape having a width scaled to the width of said roll of sheet-like material, said tape having grain indicators representative of the grain direction of said sheet-like material and rows and columns of perforations so that the tape may be torn into pieces along the perforations;

c. tearing said tape in straight lines along the perforations and into pieces which may be placed over portions of said scale model representation to stimulate the manner in which said sheet-like material is to be used to cover said predetermined area such that said entire predetermined area is covered with tape;

d. positioning said pieces of tape on said portions of said scale model representation such that the grain indicators of each piece of tape indicate that the grain direction is uniform between adjacent pieces;

e. determining the length of said tape used to cover entire scale model representation of the predetermined area;

f. multiplying said determined length of said tape by the scale of said tape to determine the length of the roll of sheet-like material required to cover the predetermined area; and g. cutting a length of the sheet-like material corresponding to the determined length of material required to cover the predetermined area;

wherein said sheet-like material has a repeating pattern and said tape contains pattern repetition indicators indicative of the distance at which the pattern of said sheet-like material repeats, and during said positioning step, said pieces of tape are positioned on said portions of said scale model representation such that the pattern repetition indicators of each piece of tape indicate a continuous pattern between adjacent pieces of said tape.

10. A method according to claim 9, wherein said pattern repetition indicators indicate 3 foot distances.

11. A method according to claim 10, wherein the rows of perforations are disposed at 1 scale foot intervals and the columns of perforations are disposed at 1 scale foot intervals.

12. A method for calculating the length of a twelve foot wide roll of sheet-like material required to cover a predetermined ar®a, wherein the sheet-like material has a pattern which repeats at three foot intervals on a surface thereof, said method comprising the steps of:

a. providing a scale model representation of the predetermined area;

b. providing a quantity of tape having a width scaled to the width of said roll of sheet-like material, said tape having pattern repetition indicators representative of the three foot distances at which said pattern repeats;

c. separating said tape into pieces which may be placed over portions of said scale model representation to stimulate the manner in which said sheet-like material is to be used to cover said predetermined area such that said entire predetermined area is covered with tape;

d. positioning said separated pieces of tape on said portions of said scale model representation such that the three foot pattern repetition indicators indicate a continuous pattern between adjacent pieces of tape;

e. determining the length of said tape used to cover the entire scale model of the predetermined area;

f. mutiplying said length of said tape by the scale of said tape to determine the length of the roll of sheet-like material used to cover the predetermined area; and g. cutting a length of the sheet-like material corresponding to the determined length of the material required to cover the predetermined area.

13. A method according to claim 12, wherein the tape has orthogonal rows and columns of perforations and the separating step is accomplished by tearing the tape along the perforations.

14. A device for determining the length of a roll of sheet-like material required to cover a defined surface area; said sheet-like material having a grain direction, said device comprising:

a length of tape stimulating the sheet-like material, said tape being perforated with orthogonal rows and columns of holes extending across the width and length, respectively, of the tape so that the tape may be torn along the perforations into rectangular pieces;

grain direction means on said tape for indicating the grain direction along the length of the sheet-like material; and re-adherable adhesive on one surface of said tape;

wherein said sheet-like material includes a regularly repeating pattern, said tape comprising pattern repetition indicators for indicating the distance intervals at which the pattern of the sheet-like material repeats.

15. A device according to claim 14, wherein said tape is 12 scale feet wide and said pattern repetition indicators indicate 3 scale foot distance intervals.

16. A device according to claim 15, wherein said tape further comprises pattern repetition indicators for indicating 1½ foot distance intervals across the width of said tape.

17. A device according to claim 15, wherein the rows of perforations are disposed at 1 scale foot intervals and the columns of perforations are disposed at 1 scale foot intervals.

* * * * *